US009011615B2

(12) United States Patent
Han et al.

(10) Patent No.: US 9,011,615 B2
(45) Date of Patent: Apr. 21, 2015

(54) BAKE HARDENING STEEL WITH EXCELLENT SURFACE PROPERTIES AND RESISTANCE TO SECONDARY WORK EMBRITTLEMENT, AND PREPARATION METHOD THEREOF

(75) Inventors: Seong-Ho Han, Gwangyang (KR); Il-Ryoung Sohn, Gwangyang (KR); Shin-Hwan Kang, Gwangyang (KR); Min-Ki Seun, Gwangyang (KR)

(73) Assignee: POSCO, Pohang-si (KR)

( * ) Notice: Subject to any disclaimer, the term of this patent is extended or adjusted under 35 U.S.C. 154(b) by 193 days.

(21) Appl. No.: 13/000,655

(22) PCT Filed: Jun. 9, 2009

(86) PCT No.: PCT/KR2009/003093

§ 371 (c)(1),
(2), (4) Date: Dec. 22, 2010

(87) PCT Pub. No.: WO2009/157661

PCT Pub. Date: Dec. 30, 2009

(65) Prior Publication Data

US 2011/0100516 A1 May 5, 2011

(30) Foreign Application Priority Data

Jun. 23, 2008 (KR) ..... 10-2008-0059281
Jun. 4, 2009 (KR) ..... 10-2009-0049398

(51) Int. Cl.
*C22C 38/04* (2006.01)
*C21D 8/02* (2006.01)
*C21D 9/46* (2006.01)
(Continued)

(52) U.S. Cl.
CPC ..... *C21D 8/0205* (2013.01); *C21D 8/0273* (2013.01); *C21D 9/46* (2013.01); *C21D 2201/03* (2013.01); *C22C 38/001* (2013.01);
(Continued)

(58) Field of Classification Search
CPC ..... C22C 38/00–38/14; C21D 8/02
USPC ..... 148/330, 602; 420/121
See application file for complete search history.

(56) References Cited

U.S. PATENT DOCUMENTS 4,589,931 A 5/1986 Yasuda et al.
8,128,763 B2 * 3/2012 Han ..... 148/330
(Continued)

FOREIGN PATENT DOCUMENTS

JP 57089437 A 6/1982
JP 61026757 A 2/1986
(Continued)

OTHER PUBLICATIONS

English language machine translation of JP 2002-012920 to Nomura. Generated Jan. 15, 2014.*

*Primary Examiner* — Brian Walck
(74) *Attorney, Agent, or Firm* — The Webb Law Firm

(57) ABSTRACT

Provided are a bake hardening steel having a crystalline grain size of ASTM No. 9 or more and a method for preparing the bake hardening steel by controlling the winding, rolling and cooling conditions. The bake hardening steel includes: C:0.0016~0.0025%, Si:0.02% or less, P:0.01~0.05%, S:0.01% or less, sol.Al:0.08~0.12%, N:0.0025% or less, Ti:0.003% or less, Nb:0.003~0.011%, Mo:0.01~0.1%, B:0.0005~0.0015% or less, balance Fe and other inevitable impurities, wherein % is weight %, and Mn and P satisfy the relation of −30(° C.)≥803P−24.4Mn−58.

7 Claims, 5 Drawing Sheets

(51) Int. Cl.
*C22C 38/00* (2006.01)
*C22C 38/06* (2006.01)
*C22C 38/12* (2006.01)

(52) U.S. Cl.
CPC ..... *C22C 38/04* (2013.01); *C22C 38/06* (2013.01); *C22C 38/12* (2013.01)

(56) References Cited

U.S. PATENT DOCUMENTS

2007/0181232 A1 8/2007 Han et al.
2008/0251168 A1* 10/2008 Han ..... 148/651

FOREIGN PATENT DOCUMENTS

| | | | |
|---|---|---|---|
| JP | 06306531 | A | 11/1994 |
| JP | 7278654 | A | 10/1995 |
| JP | 08049038 | A | 2/1996 |
| JP | 09249936 | A | 9/1997 |
| JP | 200212920 | A | 1/2002 |
| KR | 1020050095537 | A | 9/2005 |
| KR | 100564884 | A | 3/2006 |
| KR | 100685037 | B1 | 2/2007 |
| WO | WO 2007035059 | A1 * | 3/2007 |

* cited by examiner

BAKE HARDENING STEEL WITH EXCELLENT SURFACE PROPERTIES AND RESISTANCE TO SECONDARY WORK EMBRITTLEMENT, AND PREPARATION METHOD THEREOF

TECHNICAL FIELD

The present invention relates to a bake-hardenable steel having high-strength characteristics and excellent resistance to secondary work embrittlement and a manufacturing method thereof, and more particularly, to a bake-hardenable steel having high bark hardenability, excellent room-temperature aging resistance (low aging index (AI)) and excellent resistance to secondary work embrittlement, and a manufacturing method thereof.

BACKGROUND ART

In recent years, in order to improve the fuel consumption of cars and to reduce the weight of car bodies, there has been an increasing need to use high-strength steel sheets for car bodies to allow for a reduction in steel sheet thickness while improving the dent resistance thereof. Generally, when such high-strength characteristics are imparted to a steel sheet, the workability of the steel sheet is deteriorated. Thus, the demand for steels capable of satisfying both high strength and excellent workability is increasing.

Steels capable of satisfying such requirements include multiphase cold-rolled steels and bake-hardenable steels. Multi-phase structure cold-rolled steel can be easily manufactured, and has a tensile strength in the level of 390 MPa or more. Regardless of its high tensile strength as a material for automobiles, multi-phase structure cold-rolled steel has a high elongation. However, it has a low average r-value as a factor indicating the press formability of automobiles, and comprises excessive amounts of expensive alloying elements such as Mn, Cr and the like, which result in high manufacturing costs.

Bake-hardenable cold-rolled steel acts like mild steel in terms of yield strength upon press forming of steel which has a tensile strength of 390 MPa or less. Thus, bake-hardenable cold-rolled steel has excellent ductility, and spontaneously increases in yield strength during paint baking after press forming. This steel is considered ideal in comparison with conventional cold-rolled steel, which is generally deteriorated in formability as the strength of the steel increases.

Bake hardening is a process which employs a kind of strain aging occurring as interstitial elements dissolved in a solid solution state in the steel, such as solute nitrogen or solute carbon, fix dislocations created during deformation. When the steel has large amounts of solute carbon and nitrogen, the amount of bake hardenability of the steel advantageously increases; however, natural aging properties also increase due to the large amounts of solid solution elements, deteriorating formability. Thus, it is very important to optimize the amounts of solid solution elements in the steel.

Generally, a bake-hardenable cold-rolled steel sheet is manufactured by coiling a low-carbon, P-containing, Al-killed steel at a low temperature of 400~500° C. and then batch-annealing the coiled steel. Herein, a steel having a bake hardenability of about 40-50 MPa is mainly used. It is known that batch annealing in this manufacturing method can improve both the formability and bake hardenability of the steel.

Meanwhile, the P-containing Al-killed steel that should be subjected to continuous annealing is cooled at a relatively high rate, and thus it is easy to secure the bake-hardenability of the steel. However, there is a problem in that the formability of the steel is deteriorated due to a high heating rate and a short annealing process. Thus, the use of the steel sheet manufactured using batch annealing is limited only to the outer panels of automobiles, which do not require workability.

In recent years, surface-treated steel sheets have been mainly used for the production of automotive parts. In the case of galvanized steel sheets obtained by surface-treating a bake-hardenable steel, if the surface integrity of the steel sheet is not sufficiently ensured, scratch-like defects will be highly likely to occur on the steel sheet surface after a plating process. Also, brilliant surface defects will be highly likely to occur after metal sheet processing.

Such defects are generally formed because Al- and P-based composite oxides, which are formed at the surface layer (within a few μm from the surface) of the steel containing excessive amounts of Al and P during a hot-rolling process, form oxides along grain boundaries or sub-grain boundaries.

Accordingly, in order to overcome the problems of bake-hardenable steels while taking advantage of the bake-hardenable steels, various technologies have been developed. Recently, with rapid advance in steel manufacturing techniques, it has become possible to control the amount of solid solution elements in the steel and to manufacture bake-hardenable sheets having excellent formability by using Al-killed steel sheets containing strong carbide/nitride forming elements, thereby satisfying the demand for bake-hardenable cold-rolled steel sheets, which can be used for the outer panels of the automobiles requiring dent resistance.

Japanese Patent Publication No. Sho 61-026757 discloses an ultra-low-carbon cold-rolled steel sheet, which comprises: 0.0005-0.015% of C; 0.05% or less of S+N; and Ti and Nb or a combination thereof. Japanese Patent Publication No. Sho 57-089437 discloses a method for manufacturing a sheet having a bake hardenability of about 40 MPa or more using a Ti-containing steel comprising 0.010% or less of C. Such methods are techniques of imparting bake hardenability to the steel sheet while preventing deterioration in other properties of the steel sheet by appropriately controlling the amount of solid solution elements in the steel through control of the content of Ti and Nb or the cooling rate during annealing. However, for the Ti-added steel or the Ti and Nb-added steel, it is necessary to strictly control the amounts of Ti, N and S during manufacturing of the steel in order to ensure appropriate bake hardenability, and thus the manufacturing cost of the steel is increased.

Meanwhile, various methods of improving the physical properties of a bake-hardenable steel sheet through addition of alloying elements have been reported. For example, Japanese Patent Laid-Open Publication No. Hei 5-93502 discloses a method for enhancing bake hardenability by addition of Sn, and Japanese Patent Laid-Open Publication No. Hei 9-249936 discloses a method for enhancing the ductility of steel by relieving stress concentration on grain boundaries through addition of V and Nb. Also, Japanese Patent Laid-Open Publication No. Hei 8-49038 discloses a method for enhancing the formability of steel through addition of Zr, and Japanese Patent Laid-Open Publication No. Hei 7-278654 discloses a method for enhancing the formability of steel by increasing the strength of the steel while minimizing deterioration of work hardening index (N-value) through addition of Cr.

However, these methods are merely techniques of improving the bake hardenability or formability of steel and do not disclose a problem of deterioration in aging resistance resulting from an improvement of bake hardenability, and a problem of secondary work embrittlement resulting from an increase in the content of P, which is necessarily added due to an increase in the strength of bake hardenable steel. For example, when P is added in an amount of 0.07% to produce a bake hardenable steel having a tensile strength of about 340 MPa, the ductility-brittleness transition temperature (DBTT) of the steel as a reference to determine the secondary work embrittlement is −20° C. at a draw ratio of 1.9. In addition, when P is added in an amount of about 0.09% to produce a high-strength steel having a strength of about 390 MPa, the steel can have a very low DBTT of 0~10° C. The above-described methods correspond to a steel having a B content of about 5 ppm, and in these methods, it is considered that the improvement in DBTT by B cannot be achieved, because the content of P is excessively large.

If B is added in an excessive amount in order to improve the secondary work embrittlement resistance of steel, it will deteriorate the properties of the steel. For this reason, the amount of B added is limited.

Since the steel must have a DBTT of −20° C. or lower to prevent secondary work embrittlement and have a DBTT of −30° C. or lower to ensure more stable resistance to secondary work embrittlement, there is the necessity of investigating new components other than B in the bake hardenable steel and new manufacturing conditions.

An aspect of the present invention provides a steel which can simultaneously ensure high strength and resistance to secondary work embrittlement while solving the problems occurring in the prior art, and preferably a high-strength bake-hardenable steel, in which the occurrence of surface defects is suppressed and which has excellent bake hardenability and room-temperature aging resistance and a high bake hardening value, as well as a manufacturing method thereof.

SUMMARY OF THE INVENTION

According to an aspect of the present invention, there is provided a bake-hardenable steel including, by wt %, 0.0016-0.0025% of C, 0.02% or less of Si, 0.2-1.2% of Mn, 0.01-0.05% of P, 0.01% or less of S, 0.08-0.12% of Al, 0.0025% or less of N, 0.003% or less of Ti, 0.003-0.011% of Nb, 0.01-0.1% of Mo, 0.0005-0.0015% of B and a balance of Fe and inevitable impurities, wherein Mn and P satisfy the relationship: DBTT=803P−24.4Mn−58≤−30(° C.), and Al and P satisfy the relationship: $P \geq -0.048*\log_e(Al)-0.07$. Herein, the bake-hardenable steel preferably has a grain size corresponding to ASTM No. 9 or higher.

According to another aspect of the present invention, there is provided a method for manufacturing a bake-hardenable steel, the method including: heating a steel slab to a temperature of 1200° C. or higher, the steel slab including, by wt %, 0.0016-0.0025% of C, 0.02% or less of Si, 0.2-1.2% of Mn, 0.01-0.05% of P, 0.01% or less of S, 0.08-0.12% of Al, 0.0025% or less of N, 0.003% or less of Ti, 0.003-0.011% of Nb, 0.01-0.1% of Mo, 0.0005-0.0015% of B and a balance of Fe and inevitable impurities, with Mn and P satisfying the relationship: DBTT=803P−24.4Mn−58≤−30(° C.); finish-hot-rolling the heated steel slab at 900~950° C.; coiling the hot-rolled steel sheet; air-cooling the coiled steel sheet, de-scaling the cooled steel sheet, and then cold-rolling the steel sheet at a reduction ratio of 70-80%; continuously annealing the cold-rolled steel sheet at 750~830° C.; and temper-rolling the annealed steel sheet at a reduction ratio of 1.2-1.5%. In the method, the coiling step is preferably carried out at a temperature of 600~650° C. while satisfying the following relationship between Al and P: $P \leq -0.048*\log_e(Al)-0.07$. Also, the coiling step may be carried out at a temperature of 600° C. or lower without the Al—P relationship.

According to another aspect of the present invention, there is provided a method for manufacturing a bake-hardenable steel, the method including: heating a steel slab to a temperature of 1200° C. or higher, the steel slab including, by wt %, 0.0016-0.0025% of C, 0.02% or less of Si, 0.2-1.2% of Mn, 0.01-0.05% of P, 0.01% or less of S, 0.08-0.12% of Al, 0.0025% or less of N, 0.003% or less of Ti, 0.003-0.011% of Nb, 0.01-0.1% of Mo, 0.0005-0.0015% of B and a balance of Fe and inevitable impurities, with Mn and P satisfying the relationship: DBTT=803P−24.4Mn−58≤−30(° C.); finish-hot-rolling the heated steel slab at 900~950° C.; coiling the hot-rolled steel sheet at a temperature of 600~650° C.; water-cooling the coiled steel sheet within 30 minutes after the coiling step, de-scaling the cooled steel sheet, and then cold-rolling the steel sheet at a reduction ratio of 70-80%; continuously annealing the cold-rolled steel sheet at 750~830° C.; and temper-rolling the annealed steel sheet at a reduction ratio of 1.2-1.5%.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
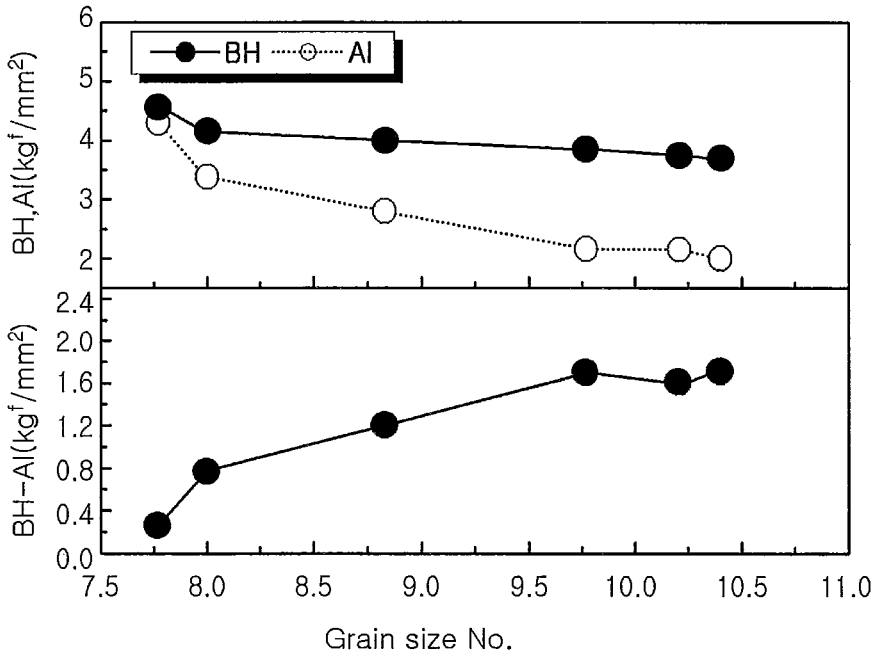
FIG. 1 is a graphic diagram showing the effects of grain size on bake hardenability and aging index.

Hereinafter, the present invention will be described in detail.

The present invention provides a bake-hardenable steel including, by weight, 0.0016-0.0025% of C, 0.02% or less of Si, 0.2-1.2% of Mn, 0.01-0.05% of P, 0.01% or less of S, 0.08-0.12% of soluble Al, 0.0025% or less of N, 0.003% or less of Ti, 0.003-0.011% of Nb, 0.01-0.1% of Mo, 0.0005-0.0015% of B and a balance of Fe and inevitable impurities. Also, the present invention provides a method for manufacturing a bake-hardenable steel, including the subjecting a steel slab having said composition to homogenization heat treatment at a temperature of 1200° C. or higher, finish hot-rolling the heat-treated steel slab at a temperature of 900~950° C., coiling the hot-rolled steel and then cooling the coiled steel. When the coiling temperature is 600~650° C., the contents of P and Al are controlled through the relationship shown in equation 1 below in order to prevent surface defects from occurring due to the selective oxidation of the surface of the hot-rolled sheet:

$$P \leq -0.048*\log_e(Al)-0.07 \quad \text{[Equation 1]}$$

In another aspect, the present invention provides a method capable of minimizing surface defects without needing to satisfy the relationship of equation 1, the method including either coiling the hot-rolled steel at a temperature of 600~650° C. and water-cooling the coiled steel within 30 minutes after the coiling process, or coiling the hot-rolled steel at a temperature of 600° C. or lower and passively cooling the coiled steel.

Also, the hot-rolled coil is descaled with a hydrochloric acid solution, cold-rolled at a reduction ratio of 70-80%, continuously annealed at a temperature of 750~830° C. and temper-rolled at a reduction ratio of 1.2-1.5%, thereby manufacturing a steel sheet.

The steel sheet manufactured as described above has a bake hardenability of 30 MPa or higher and an aging index of 30 MPa or lower as a result of minutely controlling the grain size after annealing to an ASTM No. 9 or higher. Furthermore, the contents of Mn and P may be controlled so as to satisfy the following equation 2 in order to ensure excellent DBTT characteristics, thereby providing a high-strength bake-hardenable steel of tensile strength of 340 MPa having excellent surface characteristics and high resistance to secondary work embrittlement, and a cold-rolled steel sheet and a galvanized steel sheet, which are manufactured using the method for manufacturing high-strength bake-hardenable steel.

$$DBTT=803P-24.4Mn-58\leq-30(^\circ C.) \quad \text{[Equation 2]}$$

Generally, if C or N is added to steel, it will bond with precipitate-forming elements such as Al, Ti or Nb in a hot-rolling step to form carbides/nitrides such as TiN, AlN, TiC, $Ti_4C_2S_2$ and NbC. However, carbon or nitrogen which does not bond with such carbide/nitride-forming elements will exist in a solid solution state in the steel to influence the bake hardenability or aging resistance of the steel. Particularly, because nitrogen has a very high diffusion rate compared to carbon, it greatly deteriorates the aging resistance of the steel, even though it increases the BH of the steel. For this reason, it is generally preferable to minimize the content of nitrogen in the steel. Particularly, because Al or Ti precipitates with nitrogen earlier than carbon in steel at high temperatures, it is believed that nitrogen in the steel has little or no effect on the BH or aging resistance of the steel.

However, C is an element that is necessarily contained in steel, and the content thereof determines the characteristics of the steel. Particularly, in the field of bake-hardenable steels, the role of carbon is very important, and the presence of a small amount of solute C can change the bake hardenability and aging resistance of the steel.

However, according to the position of solute c atoms in steel, that is, whether the solute C atoms exist in the grain boundary or in the grains, the effect thereof on the bake hardenability and aging resistance of the steel can vary. For example, solute C atoms that can be measured through an internal friction test are present mainly in grains, and the movement thereof is relatively free, they bind with mobile dislocations, thereby influencing the aging characteristics of the steel. An item for evaluating such aging characteristics is aging index (AI), and generally, if the AI value is 30 MPa or higher, aging defects can occur before 6 months at room temperature and lead to serious defects when the steel is press-worked.

Solute C atoms in steel are present in the grain boundary that is a relatively stable region, and thus are difficult to detect by a vibration test method such as internal friction. Also, because solute C atoms are present in the stable region, they have little or no effect on low-temperature aging characteristics such as AI. On the other hand, the solute C atoms influence high-temperature baking characteristics such as bake hardenability. Thus, it can be said that solute C atoms present in the grains influence both the aging resistance and bake hardenability of the steel, whereas solute C atoms influence only the bake hardenability of the steel.

However, because the grain boundary is a relatively stable region, all the solute C atoms present in the grain boundary do not influence the bake hardenability of the steel, and it is generally known that some (about 50%) of the solute C atoms present in the grain boundary influence the bake hardenability. If the presence of such solute C atoms can be suitably controlled, that is, if the added solute C atoms can be controlled such that they are more present in the grain boundary than in the grains, both the aging resistance and bake hardenability of the steel can be ensured.

For this purpose, it is required to suitably control the content of carbon in steel and to limit the size of the grains. This is because, if the amount of carbon added is large or small, it is frequently difficult to ensure suitable bake hardenability and aging resistance, even when the position of the solute C atoms in the steel is controlled.

FIG. 1 shows the relationship between bake hardenability (BH) and aging index (AI) according to the change in grain size. As can be seen in FIG. 1, as the grain size number (No.) increases so that the grains are refined, the decrease in AI relative to BH is more remarkable, and for this reason, the BH-AI value gradually increases so that the aging resistance becomes better. On the basis of the results shown in FIG. 1, the present inventor has attempted to reduce the grain size of the annealed sheet to a suitable level or smaller in order for solute C atoms present in the steel to be distributed in the grain boundary as much as possible. As a result, the present inventor found that it is preferable to control the grain size to ASTM No. 9 or higher in order to maximize aging resistance while minimizing deterioration in bake hardenability.

Hereinafter, components (hereinafter wt %) constituting the steel of the present invention will be described in detail.

Carbon (C) is an element exhibiting solid solution-strengthening and bake-hardening properties. If the content of carbon is less than 0.0016%, the tensile strength of the steel will be insufficient due to the very low carbon content, the bake hardenability of the steel cannot be obtained because the absolute content of carbon in the steel is low, even when Nb is added in order to refine the grains. Also, the site competition effect between solute C and P will disappear, and thus the resistance of secondary work embrittlement of the steel will significantly deteriorate. On the other hand, if the content of carbon is more than 0.0025%, the amount of solute C present in the grains will be increased in proportion to the total amount of carbon added, so that the room-temperature aging resistance of the steel will be deteriorated according to the increase in the amount of solute C in the steel, even when the grains are refined. For these reasons, the total amount of carbon added is limited to 0.0016-0.0025%.

Silicon (Si) is an element that increases the strength of the steel. As the amount of Si added increases, the strength of the steel increases, but the ductility thereof significantly deteriorates. Particularly, when it is added in an excessive amount, it can deteriorate the galvanizing property, and thus it is advantageous to add Si in the smallest possible amount. Accordingly, in order to prevent deterioration in the galvanizing property and other properties of the steel, the amount of Si added is limited to 0.02% or less.

Manganese (Mn) is an element that refines grains without impairing the ductility of the steel, completely precipitates S in the steel into MnS to prevent hot shortness from occurring due to the production of FeS and strengthens the steel. If the content of Mn is less than 0.2%, it will be difficult to ensure suitable tensile strength, and if the content of Mn is more than 1.2%, the strength of the steel will be rapidly increased due to solid solution strengthening, the formability thereof will be deteriorated, and a large amount of oxides such as MnO will be produced on the steel surface in an annealing process during the manufacture of a galvanized steel sheet, so that the coating adhesion can be deteriorated and a large amount of coating defects such as stripes can occur, thereby adversely affecting the quality of the final product. For these reasons, the amount of Mn added is limited to 0.2-1.2%.

Phosphorus (P) is a substitutional alloying element having excellent solid solution-strengthening effect and serves to improve the in-plane anisotropy and strength of the steel. Also, it refines the grains of the hot-rolled strip to promote the development of (111) texture advantageous for increasing the average r-value in a subsequent annealing step. Particularly, in terms of its influence on the bake hardenability of the steel, as the content of P increases, the bake hardenability shows an increase, because the site competition effect between P with carbon. However, P has the following two problems. First, because P promotes selective oxidation along the grain boundary on the surface of the steel sheet during high-temperature processes such as hot rolling, if the selective oxidation becomes severe, the surface layer of the steel sheet can be exfoliated, thus causing defects on the surface of the steel sheet. Also, if Al is present in the components of the steel, the selective oxidation phenomenon can accelerate.

Figure 2:
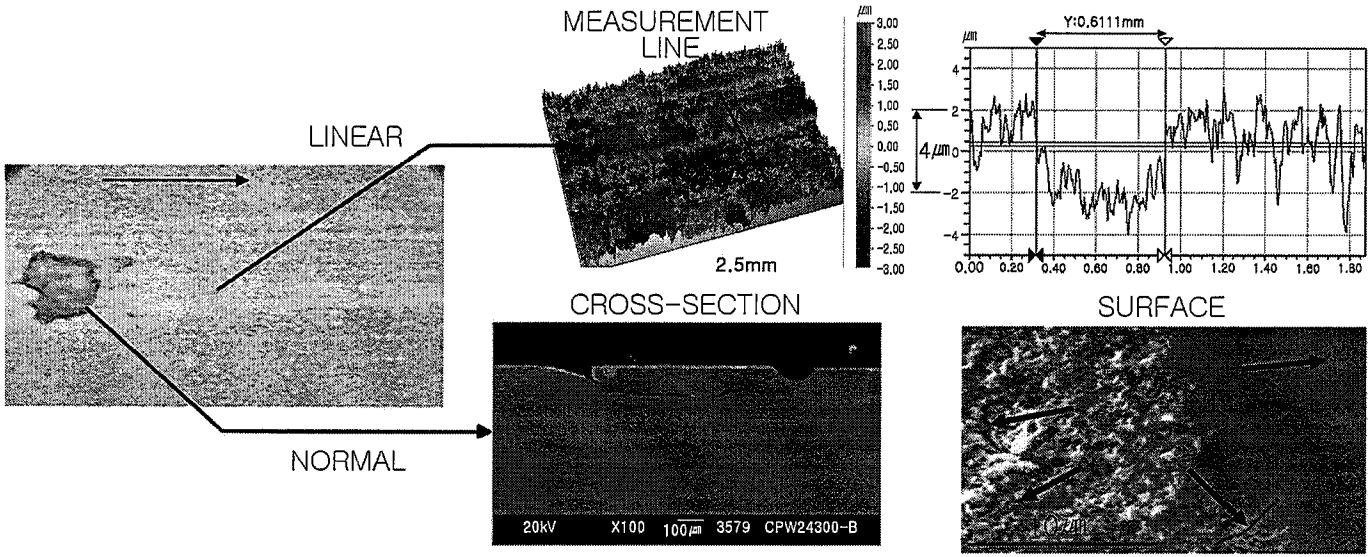
FIG. 2 shows the results of analyzing the fine structures of linear defects.

Meanwhile, the present inventors have found that such surface defects also have a close connection with the hot-rolling coiling temperature. The results of studies conducted by the present inventors showed that, when the steel sheet is coiled at a temperature of 750° C. and annealed, a large amount of P- or Al-based fine oxides are present immediately below the surface of the steel sheet, and such oxides act as the cause of linear defects as shown in FIG. 2 during a galvanizing process. Thus, if a steel sheet containing large amounts of P and Al is coiled at a high temperature, the contents of P and Al need to be limited. Furthermore, in the case in which annealing rather than water quenching is performed during a hot-rolling coiling process or in which the coiling temperature is 600° C. or lower, the time for grain boundary oxides to grow is limited and the degree of development of grain boundary oxides is weak, and thus the surface embrittlement phenomenon is relieved. In this case, it is possible to prevent the surface layer from being exfoliated during cold rolling and surface scratching from occurring due to the exfoliated material.

Thus, where water cooling is not carried out after hot-rolling coiling during the manufacturing process, the content of P is limited depending on the content of Al according to the following equation.

$$P \leq -0.048 * \log_e(Al) - 0.07 \quad \text{[Equation 1]}$$

Figure 6:
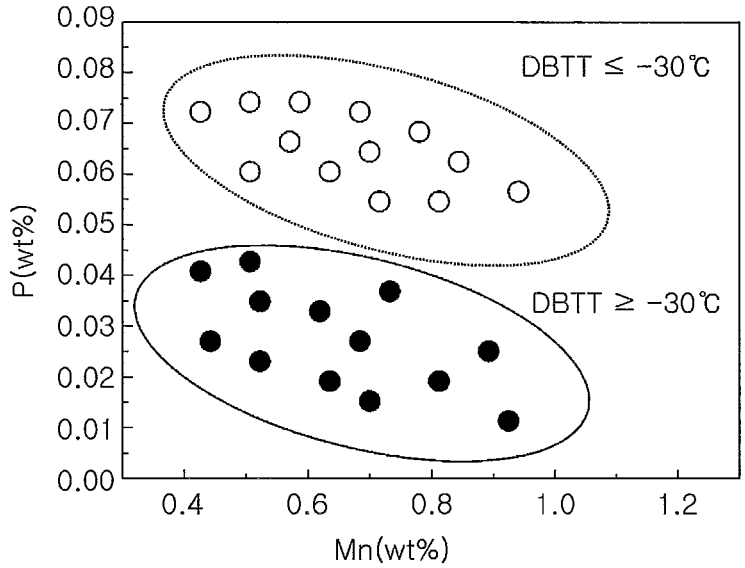
FIG. 6 is a graphic diagram showing the changes in secondary work embrittlement characteristics according to the contents of P and Mn.

When the P content increases to a specific level or higher, there is a problem in that the secondary work embrittlement resistance of the steel is deteriorated due to a decrease in the bonding force of the grain boundaries. Meanwhile, components of automobiles are generally formed to desired shapes through several iterations of press forming by automobile manufacturers. In this regard, the secondary work embrittlement means that cracks are formed during a process performed after primary press forming. When P resides in the grain boundaries of the steel, it weakens the bonding force between the grains so that the cracks propagate along the grain boundaries, causing fracturing of the steel. Basically, it is desirable that P be added to the steel in the smallest possible amount in order to prevent the secondary work embrittlement. However, P has merits in that it resides as solute P in the steel, generally serving to increase the strength of steel while suppressing reduction in elongation, and in that it is low in price. Thus, although it is considered that P is basically added for high strength of the steel, the content of P is limited to 0.01-0.05% in order to solve the problem of secondary work embrittlement caused by P, and the content of Mn is also considered in order to compensate for the decrease in strength caused by the decrease in the P content. FIG. 6 shows the relationship between DBTT characteristics and the amounts of Mn and P added. As can be seen therein, in order to ensure a DBTT of −30° C. or lower, the content of P should satisfy the relationship shown in the following equation 2 related to the contents of Mn and P.

$$DBTT = 803P - 24.4Mn - 58 \leq -30 (^\circ C.) \quad \text{[Equation 2]}$$

Sulfur (S) is an element which is precipitated into sulfides such as MnS at high temperatures, and serves to prevent the hot embrittlement caused by FeS. However, if the S content is excessive, some of the S remaining after the precipitation of MnS makes the grain boundaries brittle, possibly causing hot embrittlement. Furthermore, if S is added in an amount allowing for the complete precipitation of MnS, such a large amount of S can cause deterioration in properties of the steel due to excessive precipitation. Thus, the content of S is limited to 0.01% or less.

Aluminum (meaning soluble Al or sol.Al in the present invention) is an element which is generally used for the deoxidization of the steel. In addition, it can provide an effect of improving the grain refining effect and the effect of improving bake hardenability through the precipitation of AlN. Generally, nitrogen in Ti-added steels is coarsely precipitated into TiN at a high temperature of 1300° C., but in a steel containing a very low Ti content of 30 ppm or less such as the steel of the present invention, AlN precipitation caused by Sol.Al occurs. From the results of various experiments, when Sol.Al is present in the range of 0.02-0.06%, a conventional level, it serves to fix solute nitrogen, but if it is added in an amount of 0.08% or more, a precipitate of AlN becomes very fine and serves as a kind of barrier interfering with the growth of grains during annealing recrystallization, and thus the grains become finer than those of a Nb-added steel containing no sol.Al, such that the effect of increasing the bake hardenability of the steel without changing the AI value thereof cannot be obtained. To obtain this effect, Al is added in an amount of 0.08% or more. However, when the Al content is above 0.12%, oxide inclusions are increased during manufacture of the steel to cause a degradation of surface quality. Furthermore, the excessive content of Al can result in high manufacturing costs. For these reasons, the content of Al is limited to 0.08-0.12%.

Nitrogen (N) exists in a solid solution state before or after annealing to deteriorate the formability of the steel. Furthermore, since nitrogen imparts a faster aging characteristic than other interstitial solid solution elements, it is necessary to fix nitrogen by the use of Ti or Al. In the case in which Nb is added in a suitable amount together with the addition of a small amount of Ti, if nitrogen is added in an excessive amount, solute nitrogen in the steel will occur. Since nitrogen has a higher diffusion speed than carbon, when nitrogen exists as solute nitrogen in the steel, the aging resistance at room temperature is deteriorated significantly more than the case of solute carbon. In addition, since the yield strength is increased and the r-value of steel and the elongation are lowered due to the solute nitrogen, the content of nitrogen needs to be limited to 0.0025% or less as in the present invention.

Ti is a carbide/nitride-forming element that forms nitrides such as TiN, sulfides such as TiS or $Ti_4C_2S_2$, and carbides such as TiC, in the steel. Ti is added in an amount of 0.003% or less in order to fix a small amount of nitrogen. The reason why Ti is added in a very small amount is because various components added in order to satisfy the properties of the steel during the steel manufacturing process may contain a very small amount of Ti and also because, when the steel is tapped several times due to the continuous casting of the steel, Ti present in a steel that is tapped in advance may be incorporated into the steel of the present invention. Thus, in the case in which Nb is used as a main material to improve the aging resistance of the steel, as in the case of the steel of the present invention, Ti does not need to be added separately, and the content of Ti is limited to a very small amount of 0.003% or less because it can be inevitably added, even though the addition of Ti can deteriorate the BH of the steel.

Nb is a strong carbide and nitride forming element and serves to fix carbon in the steel to form an NbC precipitate. In particular, the produced NbC precipitate is very fine compared to other precipitates, and thus it can act as a strong barrier to interfere with the growth of grains during recrystallization annealing. Thus, the grain refining effect of Nb is attributable to the effect of this NbC precipitate, and this allows solute C to reside in the steel, thereby realizing bake hardenability by solute C. For this reason, it is required to suitably control the amount of the NbC precipitate in the steel and to allow solute C to reside in the steel in such a way as to minimize deterioration in the properties of the steel. Thus, in order to realize the grain refining effect of the NbC precipitate and ensure the bake hardenability through the presence of solute C in the steel, the content of Nb is limited to 0.003-0.11% in consideration of the carbon content (16-25 ppm).

Mo is present in solid solution in the steel to improve the strength of the steel or form Mo-based carbides. Particularly, when Mo is present in the state of solid solution in the steel, it serves to increase the bonding force of the grain boundaries, thereby preventing grain boundary fracture caused by phosphorus (P), that is, improving the resistance to secondary work embrittlement of the steel. Also, it suppresses the diffusion of carbon through its affinity for solute C to improve the aging resistance of the steel. Thus, Mo is added in an amount of 0.01% or more. However, if the content of Mo is more than 0.1%, the effect of improving the resistance to secondary work embrittlement and aging resistance of the steel will be saturated, and economic efficiency will also be reduced. For this reason, the content of Mo is limited to the range of 0.01-0.1%.

B is present as an interstitial element in the steel, and is dissolved in the grain boundary or binds with nitrogen to form a nitride of BN. B has a very great effect on the properties of the steel even when it is added in a small amount, and thus the content thereof needs to be strictly limited. Namely, if even a small amount of B is added to the steel, it will be segregated at the grain boundary to improve the resistance of secondary work embrittlement of the steel, but if it is added in a given amount or more, it will increase the strength of the steel and significantly reduce the ductility of the steel. For these reason, the content of B is limited to 0.0005-0.0015%.

The steel slab having the above-described composition is heated to a temperature of 1200° C. or higher at which the austenite structure can be sufficiently homogenized, before it is hot-rolled. Then, the heated steel slab is subjected to finish hot rolling at a temperature of 900~950° C. which is just above the $Ar_3$ temperature.

If the slab temperature is lower than 1200° C., the structure of the steel cannot become uniform austenite grains, and mixed grains can occur, thereby deteriorating the properties of the steel. If the hot-rolling finish temperature is lower than 900° C., the top, tail and edge of the hot-rolled coil become single-phase regions, so that the in-plane anisotropy of the steel can be increased and the formability of the steel can be deteriorated. On the other hand, if the hot-rolling finish temperature is higher than 950° C., significantly coarse grains will occur, thus causing defects such as orange peel defects on the steel surface after processing.

Figure 3:
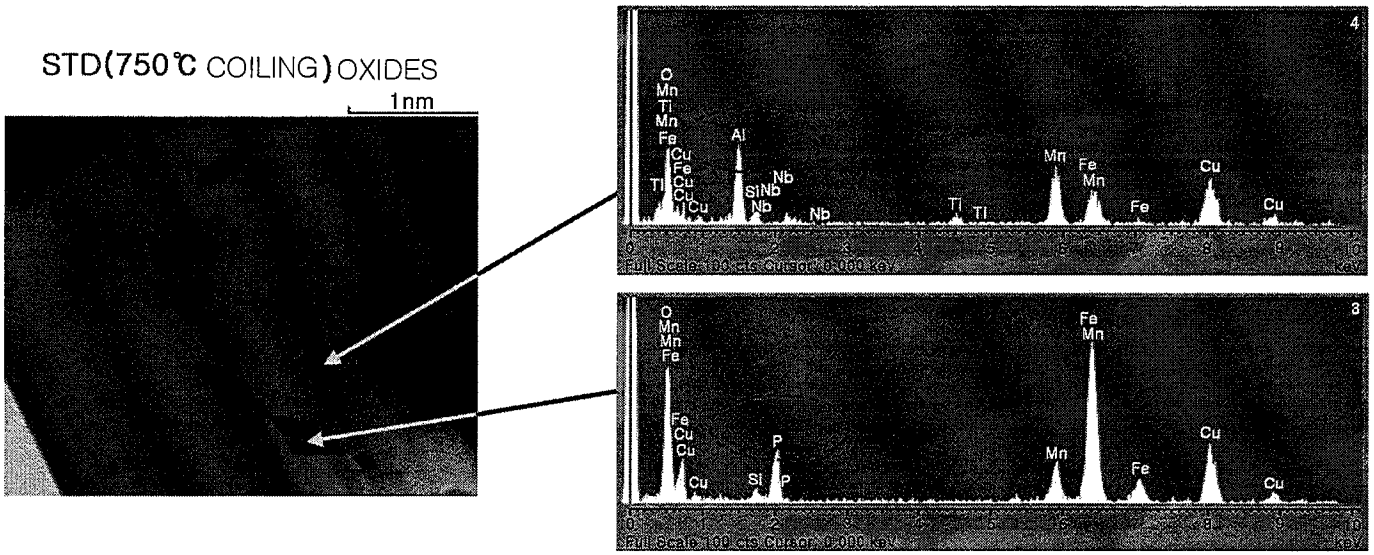
FIG. 3 shows fine oxides formed at the grain boundary of the metal surface of a steel sheet coiled at 750° C. and the results of EDS analysis of the fine oxides.

In order to ensure a suitable grain size corresponding to ASTM No. 9 or higher after the hot-rolling process and to prevent the formability of the steel from being deteriorated due to excessive grain refining, in the present invention, a coiling step is carried out while controlling the relationship of Al—P. In a first aspect, the coiling step is carried out at a temperature of 600~650° C. If the coiling temperature is higher than 650° C., the size of grains after annealing will increase, so that a sufficient grain refining effect cannot be obtained even when other conditions are satisfied. Also, in this case, the grain boundary segregation of P will increase, and internal oxides of Al—P as shown in FIG. 3 will increase, thus deteriorating the resistance to secondary work embrittlement of the steel. On the other hand, if the coiling temperature is lower than 600° C., the selective oxidation of the hot-rolled surface layer by Al and P will decrease, but the load of the hot-rolling process will increase. If the steel sheet is air-cooled after coiling, it is important to satisfy equation 1 indicating the relationship of Al—P.

Figure 5:
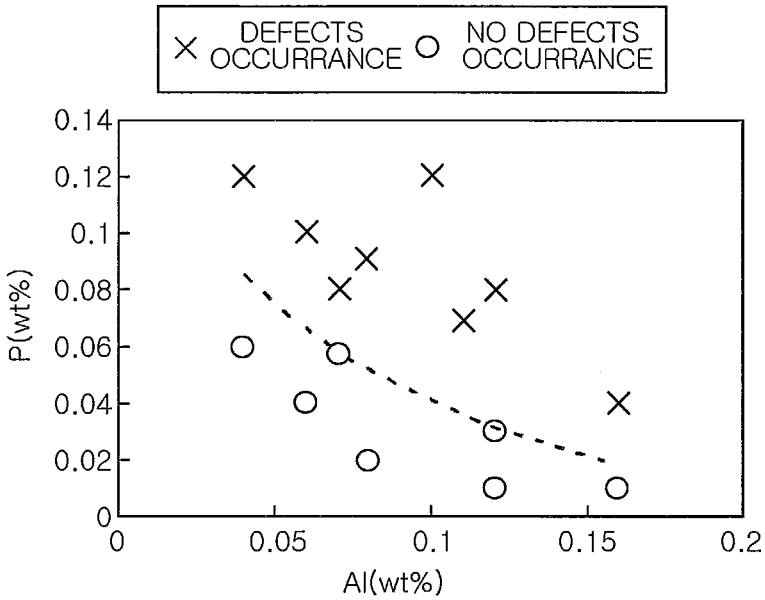
FIG. 5 is a graphic diagram showing defect areas and non-defect areas according to the contents of P and Al.

FIG. 5 shows the results of observing the grain boundary oxidation of the surface of hot-rolled steel sheets having various contents of P and Al at 620° C. In FIG. 5, "X" indicates the case in which surface embrittlement can occur; and "O" indicates the case in which surface embrittlement scarcely occurs. As can be seen in FIG. 5, in order to prevent surface embrittlement, the contents of Al and P should be suitably controlled.

According to a second aspect of the present invention, the growth of selective oxides on the surface of the hot-rolled steel sheet can be suppressed by performing water cooling within 30 minutes after coiling, even when the relationship of an equation is not satisfied. Furthermore, according to a third aspect of the present invention, the coiling process may be carried out at a temperature of 600° C. or lower.

Figure 4:
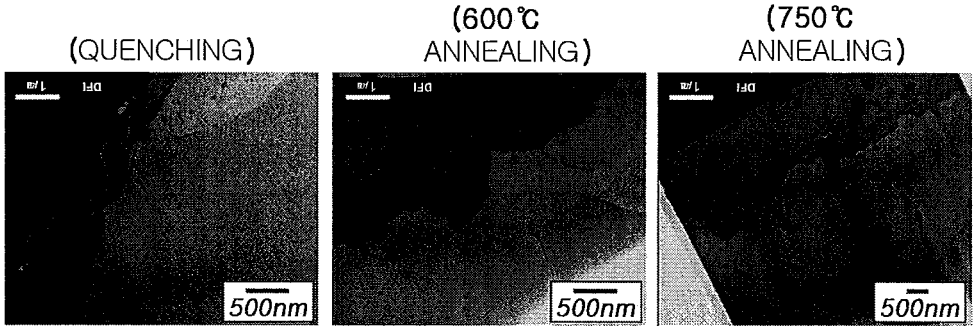
FIG. 4 is a set of photographs showing the distribution of fine oxides in the metal surface layer according to the coiling temperature.

In the third aspect of the present invention, the relationship of Al—P does not need to be satisfied, and the embrittlement of the steel sheet surface can be prevented only by controlling the coiling temperature. The third aspect apparently seems to be more advantageous than the first aspect, because it uses a lower coiling temperature and is not restricted by the relationship of Al—P, but a lower coiling temperature is not always preferable in processes. Thus, a bake-hardenable steel may be manufactured under suitable coiling conditions depending on the kind or nature of subsequent process. FIG. 4 is a set of micrographs showing the distribution of fine oxides according to such coiling temperature conditions.

The hot-rolled steel is pickled in acid according to a conventional method and then cold-rolled at a high reduction ratio of 70-80%. The reason why the cold-rolling reduction ratio is as high as 70% or more is because, at this reduction ratio, the grain refining effect is shown to improve the aging resistance and formability (particularly the r-value) of the steel. On the other hand, if the cold-rolling reduction ratio is more than 80%, the grain refining effect will increase, but the degree of refining of the grains will excessively increase due to the excessively high reduction ratio, thus deteriorating the properties of the steel, and the r-value of the steel will also gradually decrease as the reduction ratio increases.

The cold-rolled steel is continuously annealed at a temperature of 750~830° C. according to a conventional method. Because an Nb-containing steel has a recrystallization temperature higher than that of a Ti-containing steel, it is annealed at a temperature of 750° C. or higher, and preferably 770° C. or higher. If the annealing temperature is lower than 750° C., non-crystallized grains can exist to increase the yield strength of the steel and deteriorate the elongation and r-value of the steel. On the other hand, the annealing temperature is higher than 830° C., the formability of the steel can be improved, but the size of the grains will be smaller than a grain size corresponding to ASTM No. 9 which is sought in the present invention, and thus the AI value of the steel will be less than 30 MPa, thus deteriorating the aging resistance of the steel.

The bake-hardenable steel manufactured according to the above-described manufacturing method is temper-rolled at a reduction ratio of 1.2-1.5%, which is a little higher than a conventional temper-rolling reduction ratio, in order to ensure suitable bake hardenability together with room-temperature aging resistance. If the temper-rolling reduction ratio is a little higher than 1.2%, it is possible to prevent the room-temperature aging resistance from being deteriorated due to solute C in the steel. On the other hand, if the temper-rolling reduction ratio is more than 1.5%, the room-temperature aging resistance of the steel can be improved, but the work hardening of the steel will occur, thus deteriorating the properties of the steel. Particularly, in the latter case, when the steel is manufactured into a galvanized steel sheet, the coating adhesion of the steel sheet will be deteriorated due to the excessive tempering rolling, whereby the exfoliation of the coating layer can occur. For these reasons, the temper-rolling reduction ratio is limited to 1.2-1.5%.

MODE FOR INVENTION

Hereinafter, the present invention will be described in detail with reference to examples.

Examples

Table 1 below shows the chemical compositions of inventive steels in which the contents of C, P, Ti, Nb, Sol.Al and Mo were strictly controlled in order to satisfy the surface characteristics and properties of the steels, and of comparative steels.

TABLE 1

| | Chemical composition (wt %) | | | | | | | | | |
|---|---|---|---|---|---|---|---|---|---|---|
| Steel | C | Mn | P | S | Sol.A1 | Ti | Nb | N | Mo | B |
| Inventive steel 1 | 0.0021 | 0.58 | 0.032 | 0.0082 | 0.087 | 0 | 0.008 | 0.0016 | 0.034 | 0.0005 |
| Inventive steel 2 | 0.0022 | 0.73 | 0.012 | 0.0081 | 0.098 | 0 | 0.01 | 0.0024 | 0.048 | 0.0005 |
| Inventive steel 3 | 0.0023 | 0.75 | 0.022 | 0.0058 | 0.105 | 0.0025 | 0.0082 | 0.0019 | 0.061 | 0.0007 |
| Inventive steel 4 | 0.002 | 0.61 | 0.031 | 0.0083 | 0.118 | 0.0015 | 0.0073 | 0.0015 | 0.059 | 0.0005 |
| Inventive steel 5 | 0.0017 | 0.98 | 0.036 | 0.0070 | 0.105 | 0 | 0.004 | 0.0017 | 0.051 | 0.0008 |
| Inventive steel 6 | 0.0019 | 1.01 | 0.04 | 0.0063 | 0.089 | 0 | 0.005 | 0.0020 | 0.062 | 0.0009 |
| Comparative steel 1 | 0.0054 | 0.64 | 0.039 | 0.0071 | 0.082 | 0.001 | 0.011 | 0.0017 | 0.021 | 0.0007 |
| Comparative steel 2 | 0.0022 | 0.63 | 0.036 | 0.0085 | 0.04 | 0.025 | 0.009 | 0.0015 | 0.015 | 0.0005 |
| Comparative steel 3 | 0.0012 | 0.65 | 0.04 | 0.0072 | 0.075 | 0.001 | 0.0105 | 0.0019 | 0.059 | 0.0008 |
| Comparative steel 4 | 0.0021 | 0.93 | 0.036 | 0.0089 | 0.043 | 0 | 0.022 | 0.0017 | 0.021 | 0.0006 |
| Comparative steel 5 | 0.0022 | 0.049 | 0.062 | 0.0066 | 0.071 | 0.002 | 0.009 | 0.0022 | 0 | 0.0007 |
| Comparative steel 8 | 0.0023 | 0.98 | 0.12 | 0.0078 | 0.098 | 0.001 | 0.009 | 0.0023 | 0.031 | 0 |

The steels shown in Table 1 above were hot-rolled at hot-rolling coiling temperature of 610~640° C., cold-rolled at a reduction ratio of 70-78%, continuously annealed at a temperature of 780~830° C., galvanized at 460° C., galvannealed at 530° C., and then temper-rolled at a reduction ratio of about 1.5%. The temper-rolled steel sheets were measured for coating defects, bake hardenability (BH), AI value, grain size, and DBTT at a work ratio of 2.0, which is an item for evaluating resistance to secondary work embrittlement. The results of the measurements are shown in Table 2 below.

TABLE 2

| Steel | CT | Annealing temperature | TS | BH (MPa) | AI (MPa) | Grain size No. | DBTT(° C.) | Coating defects |
|---|---|---|---|---|---|---|---|---|
| Inventive steel 1 | 620° C. | 800° C. | 355.8 | 42.7 | 22.8 | 10.5 | −45 | ⊙ |

TABLE 2-continued

| Steel | CT | Annealing temperature | TS | BH (MPa) | AI (MPa) | Grain size No. | DBTT(° C.) | Coating defects |
|---|---|---|---|---|---|---|---|---|
| Inventive steel 2 | 620° C. | 810° C. | 357.3 | 40.2 | 16.8 | 9.8 | −65 | ⊙ |
| Inventive steel 3 | 620° C. | 780° C. | 361.4 | 41.3 | 17.9 | 9.9 | −60 | ⊙ |
| Inventive steel 4 | 610° C. | 800° C. | 365.7 | 44.4 | 20.5 | 10.5 | −50 | ⊙ |
| Inventive steel 5 | 640° C. | 790° C. | 357.9 | 50.2 | 29.1 | 10.0 | −50 | ⊙ |
| Inventive steel 6 | 620° C. | 820° C. | 367.8 | 47.6 | 25.7 | 11.1 | −50 | ⊙ |
| Comparative steel 1 | 620° C. | 810° C. | 370.0 | 62.7 | 51.2 | 11.2 | −40 | ⊙ |
| Comparative steel 2 | 640° C. | 800° C. | 346.2 | 16.1 | 12.5 | 8.1 | −40 | ⊙ |
| Comparative steel 3 | 620° C. | 810° C. | 368.9 | 0.0 | 0.0 | 8.2 | −40 | ⊙ |
| Comparative steel 4 | 630° C. | 800° C. | 391.4 | 0.0 | 0.0 | 9.1 | −50 | ⊙ |
| Comparative steel 5 | 620° C. | 810° C. | 349.3 | 38.3 | 24.1 | 10.9 | 0 | x |
| Comparative steel 8 | 640° C. | 820° C. | 407.2 | 40.9 | 20.6 | 9.8 | 15 | x |

(Coating defects: ⊙ (not more than 10 defects per km);
Δ (10-100 defects per km);
x (more than 100 defects per km)).

As can be seen in Table 2 above, the inventive steels had a grain size corresponding to an ASTM No. 9.8-11.5 (average grain size: 6.7-12.0 μm), suggesting that the inventive steels all satisfied the requirement of an ASTM No. 9 or higher. Also, the inventive steels had a BH value of 38.1-50.2 MPa and an AI value of 8.0-29.1 MPa, suggesting that the inventive steels had very excellent bake hardenability and aging resistance. In addition, the inventive steels had a DBTT lower than −45° C., suggesting that the inventive steels sufficiently satisfied the requirement of a DBTT lower than −30° C. Furthermore, the inventive steels had not more than 10 coating defects per km of coil as a result of suitably controlling the content of P, suggesting that the inventive steels provided very excellent products.

On the other hand, comparative steel 1 had a high C content of 0.0054%, and thus satisfied process conditions such as hot-rolling coiling temperature and annealing temperature. Also, it showed a very small grain size corresponding to an ASTM No. 11.2. However, because it had a high carbon content, it showed a very high BH value and an Al value of 51.2 MPa out of a suitable range.

In the case of comparative steel 2, because the Sol.Al and Ti contents were out of the suitable ranges specified in the present invention, and thus the grain refining effect of AlN and the effect of increasing the BH value were not shown. Furthermore, due to a high Ti content, carbon atoms in the steel were precipitated into TiC, causing a problem in terms of bake hardenability. In addition, due to a high Ti content, the steel became somewhat mild, resulting in a little increase in the grain size.

In the case of comparative steel 3, because the content of C was low, the grains became course and the BH characteristic was not obtained. Also, because the Sol.Al content was out of the suitable range specified in the present invention, and thus the grain refining effect of AlN and the effect of increasing the BH value were not shown.

In the case of comparative steel 4, because the Sol.Al and Nb contents were out of the suitable ranges specified in the present invention, the grain refining effect and the effect of improving the BH value could not be obtained. In addition, because the Nb content was high, all the solute C atoms in the steel were precipitated into NbC, and thus the BH value was not obtained.

In the case of comparative steel 5, because the P content was high and no Mo was added, the effect of improving resistance to secondary work embrittlement by B was not shown. Also, because the P content was as high as 0.062%, the interaction between P and Al occurred, and for this reason, surface oxides increased from the hot-rolling step. Due to this increase in the oxides, large amounts of surface defects such as linear defects occurred during the galvanizing process.

In the case of comparative steel 8, the P content was 0.12% which was much higher than 0.01-0.05%, and B was not added. The DBTT characteristics were slightly improved by Mo, but the effect of improving the DBTT characteristics was limited because the amount of P added was very high. Particularly, because B was not added, the effect of improving the DBTT characteristics was very low. For these reasons, the DBTT of the steel was very high (15° C.), and particularly, surface defects on the galvanized steel were significantly increased because P was added in an excessive amount.

While the present invention has been shown and described in connection with the exemplary embodiments, it will be apparent to those skilled in the art that modifications and variations can be made without departing from the spirit and scope of the invention as defined by the appended claims.

As described above, the bake-hardenable steel according to the present invention has excellent room-temperature aging resistance, a bake hardenability higher than 30 MPa, and high-strength characteristics, including a tensile strength of 340-390 MPa, and thus is suitable for use in various automotive components.

The invention claimed is:

1. A bake-hardenable steel comprising, by wt %, 0.0016-0.0025% of C, 0.02% or less of Si, 0.2-1.2% of Mn, 0.01-0.04% of P, 0.01% or less of S, 0.08-0.12% of Al, 0.0025% or less of N, 0.003% or less of Ti, 0.003-0.011% of Nb, 0.01-0.1% of Mo, 0.0005-0.0015% of B and a balance of Fe and inevitable impurities, wherein Mn and P satisfy the relationship: DBTT=803P−24.4Mn−58≤−30(° C.), Al and P satisfy the relationship: $P \leq -0.048 * \log_e(Al) - 0.07$, and the bake-hardenable steel has a grain size corresponding to ASTM No. 9 or more.

2. A method for manufacturing a bake-hardenable steel, comprising:

heating a steel slab to a temperature of 1200° C. or higher, the steel slab comprising, by wt %, 0.0016-0.0025% of C, 0.02% or less of Si, 0.2-1.2% of Mn, −0.01-0.04% of P, 0.01% or less of S, 0.08-0.12% of Al, 0.0025% or less of N, 0.003% or less of Ti, 0.003-0.011% of Nb, 0.01-0.1% of Mo, 0.0005-0.0015% of B and a balance of Fe and inevitable impurities, with Mn and P satisfying the relationship: DBTT=803P−24.4Mn−58≤−30(° C.) and Al and P satisfy the relationship: $P \leq -0.048 * \log_e(Al) - 0.07$;

finish-hot-rolling the heated steel slab at 900~950° C.;

coiling the hot-rolled steel sheet;

air-cooling the coiled steel sheet, de-scaling the cooled steel sheet, and then cold-rolling the steel sheet at a reduction ratio of 70-80%;

continuously annealing the cold-rolled steel sheet at 750~830° C.; and temper-rolling the annealed steel sheet at a reduction ratio of 1.2-1.5% wherein the bake-hardenable steel has a grain size corresponding to ASTM No 9 or more.

3. The method of claim 2, wherein the coiling step is carried out at a temperature of 600~650° C. while satisfying the following relationship between Al and P: $P \leq -0.048 * \log_e(Al) - 0.07$.

4. The method of claim 2, wherein the coiling step is carried out at a temperature of 600° C. or lower.

5. A method for manufacturing a bake-hardenable steel, comprising:

heating a steel slab to a temperature of 1200° C. or higher, the steel slab comprising, by wt %, 0.0016-0.0025% of C, 0.02% or less of Si, 0.2-1.2% of Mn, −0.01-0.04% of P, 0.01% or less of S, 0.08-0.12% of Al, 0.0025% or less of N, 0.003% or less of Ti, 0.003-0.011% of Nb, 0.01-0.1% of Mo, 0.0005-0.0015% of B and a balance of Fe and inevitable impurities, with Mn and P satisfying the relationship: DBTT=803P−24.4Mn−58≤−30(° C.) and Al and P satisfy the relationship: $P \leq -0.048 * \log_e(Al) - 0.07$;

finish-hot-rolling the heated steel slab at 900~950° C.;

coiling the hot-rolled steel sheet at a temperature of 600~650° C.;

water-cooling the coiled steel sheet within 30 minutes after the coiling step, de-scaling the cooled steel sheet, and then cold-rolling the steel sheet at a reduction ratio of 70-80%;

continuously annealing the cold-rolled steel sheet at 750~830° C.; and temper-rolling the annealed steel sheet at a reduction ratio of 1.2-1.5% wherein the bake-hardenable steel has a grain size corresponding to ASTM No 9 or more.

6. A product formed from the steel of claim 1.

7. The bake-hardenable steel of claim 1, wherein the bake-hardenable steel has a grain size corresponding to ASTM No. 9.8 or more.

* * * * *